US006119816A

United States Patent [19]

Fujita

[11] Patent Number: 6,119,816

[45] Date of Patent: Sep. 19, 2000

[54] EMERGENCY STOP RELEASING METHOD FOR ELEVATOR

[75] Inventor: Yoshiaki Fujita, Tokyo, Japan

[73] Assignee: Kabushiki Kaisha Toshiba, Kawasaki, Japan

[21] Appl. No.: 09/390,659

[22] Filed: Sep. 7, 1999

[30] Foreign Application Priority Data

Sep. 4, 1998 [JP] Japan ..... 10-251123

[51] Int. Cl.[7] ..... B66B 1/40

[52] U.S. Cl. ..... 187/291; 187/288

[58] Field of Search ..... 187/287, 288, 187/290, 291, 282, 298, 900

[56] References Cited

U.S. PATENT DOCUMENTS

| | | | |
|---|---|---|---|
| 3,469,657 | 9/1969 | Sgroi | 187/290 |
| 3,706,357 | 12/1972 | Simpson | 187/290 |
| 4,434,875 | 3/1984 | Scarzella | 187/288 |
| 4,529,066 | 7/1985 | Wiechel | 187/290 |
| 5,202,539 | 4/1993 | Lamb | 187/288 |
| 5,693,919 | 12/1997 | Sager et al. | 187/282 |

FOREIGN PATENT DOCUMENTS

| | | |
|---|---|---|
| 236188 | 9/1989 | Japan . |
| 2-270792 | 11/1990 | Japan . |
| 3-36185 | 2/1991 | Japan . |
| 3-297776 | 12/1991 | Japan . |

*Primary Examiner*—Jonathan Salata
*Attorney, Agent, or Firm*—Oblon, Spivak, McClelland, Maier & Neustadt, P.C.

[57] ABSTRACT

An emergency stop state releasing method for an elevator, which includes a cage configured to ascend and descend along a first guide rail in an elevator shaft, a counterweight configured to ascend and descend along a second guide rail in the elevator shaft, a cable for suspending the cage and the counterweight, a drive unit in the elevator shaft for driving the cable to move the cage up and down in the elevator shaft, and an emergency stop mechanism attached to the cage and configured to engage the guide rail, thereby urgently stopping the cage, and to lift the cage, thereby canceling an emergency stop state, including the steps of setting a removable winding device in the elevator shaft, and driving one of the cage and the counterweight by means of the winding device to lift the cage and cancel the emergency stop state.

6 Claims, 9 Drawing Sheets

EMERGENCY STOP RELEASING METHOD FOR ELEVATOR

CROSS REFERENCE TO RELATED APPLICATION

This application claims benefit of priority to Japanese Patent Application No. JP10-251123 filed Sep. 4, 1998, the entire disclosure of which is incorporated by reference herein.

BACKGROUND OF THE INVENTION

1. Field of the Invention

The present invention relates to an emergency stop releasing method for releasing an emergency stop state of an elevator.

2. Description of the Background

With the increasing construction of high-rise buildings, the operating speed of elevators is becoming higher and higher, thus requiring satisfactory safe measures. A conventional elevator apparatus includes an elevator shaft, extending vertically in a building, and a machine room (penthouse), which is located right over the shaft and stores a motor and the like. This elevator apparatus further includes a sheave located in the machine room and driven by means of the motor, a cage disposed in the shaft and connected to one portion of a cable that is placed around the sheave, and a counterweight connected to another portion of the cable and balanced with the cage. The cage is moved up and down by rotating the sheave by means of the motor in the machine room. The cage and the counterweight are guided by means of guide rails arranged in the elevator shaft.

The elevator apparatus of this type is provided with an emergency stop device that can stop the cage safely and securely in case the cage suddenly descends for any reason at a speed higher than its rated speed. The emergency stop device brakes and stops the cage in a manner such that wedge members, for example, are caught between the cage and the guide rails.

If the emergency stop device is activated, especially when people are confined to the cage, the device should be capable of being urgently released to rescue the people from the cage. In order to release the emergency stop device of this type, the cage must be slightly lifted to allow the wedge members to slip out from between the cage and the guide rails.

In the case of conventional elevators, an operator enters the machine room and manually rotates a motor of a drive unit by means of a handle, thereby gradually lifting the cage to release the emergency stop device.

If the machine room, which stores various devices including the drive unit, control device, etc., is located over the elevator shaft, as mentioned before, however, it projects above the rooftop of the building, for example, possibly resulting in blocking access to sunshine. Recently, therefore, a machine-room-less elevator has become the object of attention in the art. In the elevator of this type, no machine room is located over the elevator shaft, and a small-sized drive unit instead is provided in a narrow space in the upper or middle part of the shaft.

In the case of the elevator having the drive unit arranged in this manner, however, the emergency stop device cannot be released with ease once it is activated. Since the drive unit is located in a narrow space in the elevator shaft, the operator cannot enter the space and manually actuate the drive unit. Thus, it is very difficult to release the emergency stop device.

SUMMARY OF THE INVENTION

Accordingly, in consideration of the above-identified circumstances, an object of the present invention is to provide an emergency stop device releasing method for an elevator, whereby an activated emergency stop device can be released quickly to rescue people who are confined to a cage, for example.

This object is achieved according to the present invention, by providing an emergency stop state releasing method for an elevator, which includes a cage configured to ascend and descend along a first guide rail in an elevator shaft, a counterweight configured to ascend and descend along a second guide rail in the elevator shaft, a cable for suspending the cage and the counterweight, a drive unit in the elevator shaft for driving the cable to move the cage up and down in the elevator shaft, and an emergency stop mechanism attached to the cage and configured to engage the guide rail, thereby urgently stopping the cage, and to lift the cage, thereby canceling an emergency stop state, including the steps of setting a removable winding device in the elevator shaft, and driving one of the cage and the counterweight by means of the winding device to lift the cage and cancel the emergency stop state.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
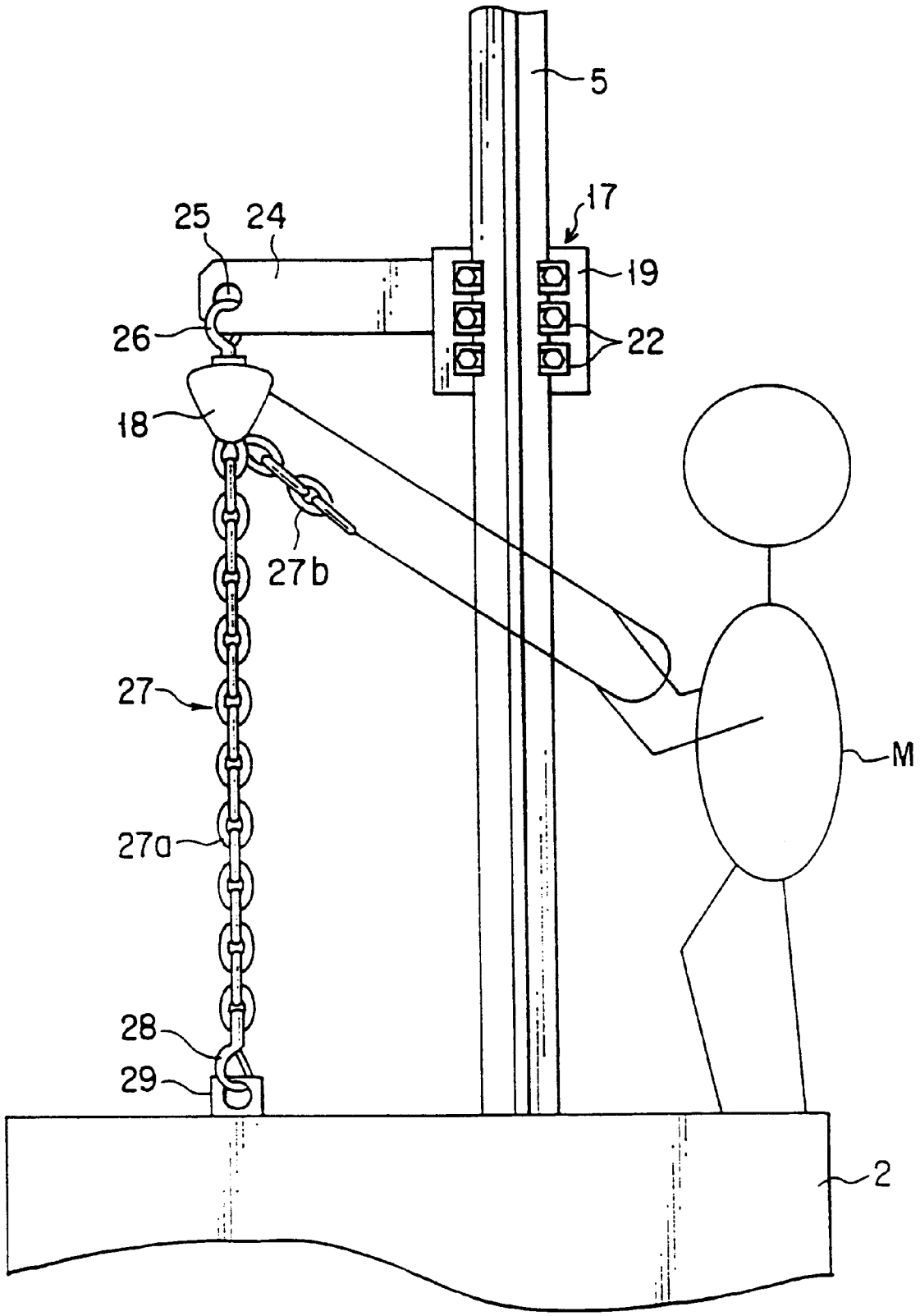
FIG. 1 is a front view showing a winding device according to a first embodiment of the present invention.

Referring now to the drawings, wherein like reference numerals designate identical or corresponding parts throughout the several views, various embodiments of the present invention will now be described.

Figure 2A:
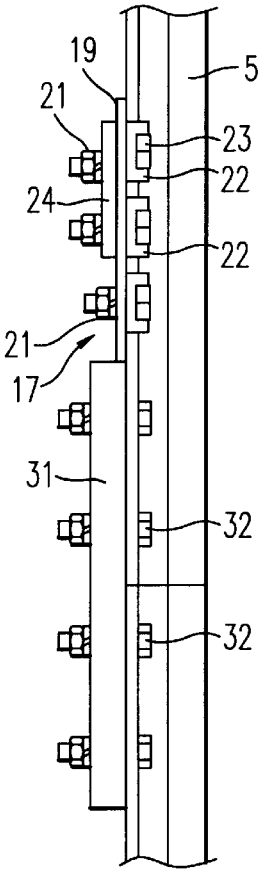
FIG. 2A is a side view of a rail clip according to the first embodiment.
Figure 2B:
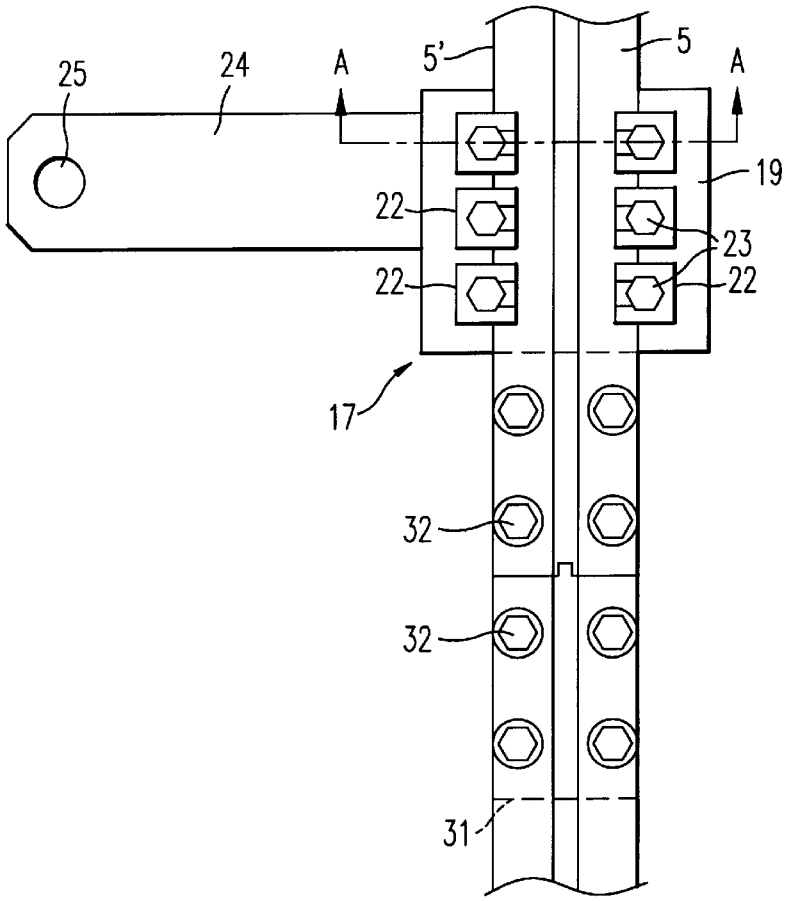
FIG. 2B is a front view of the rail clip.
Figure 2C:
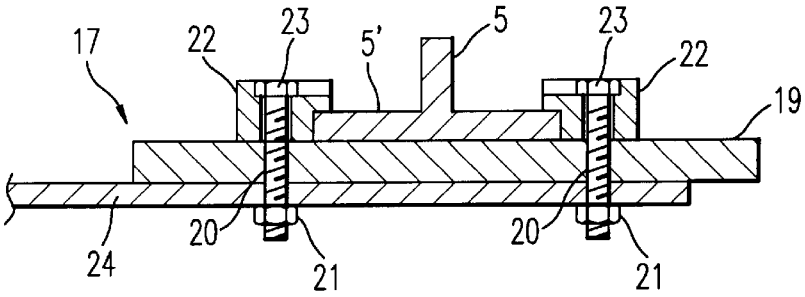
FIG. 2C is a sectional view taken along line A—A shown in FIG. 2B.
Figure 3A:
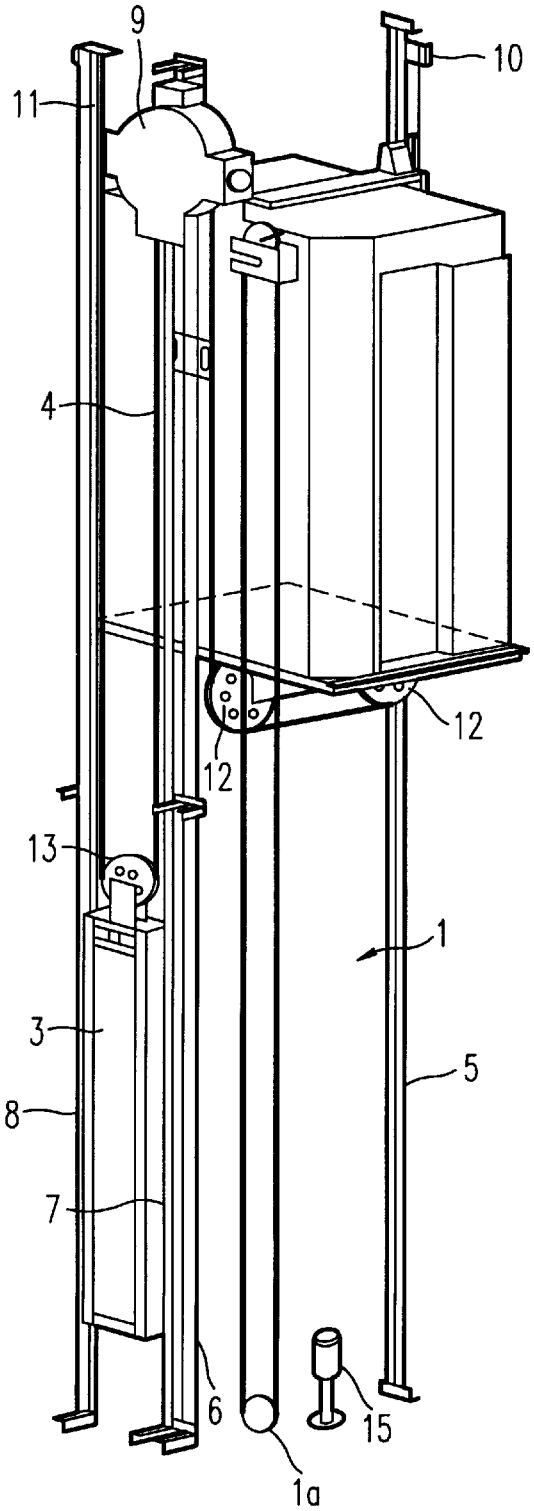
FIG. 3A is a schematic view showing an outline of an elevator.
Figure 3B:
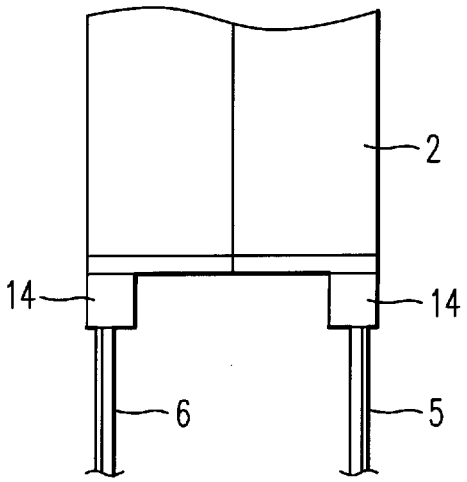
FIG. 3B is a front view showing a layout of an emergency stop device.
Figure 4:
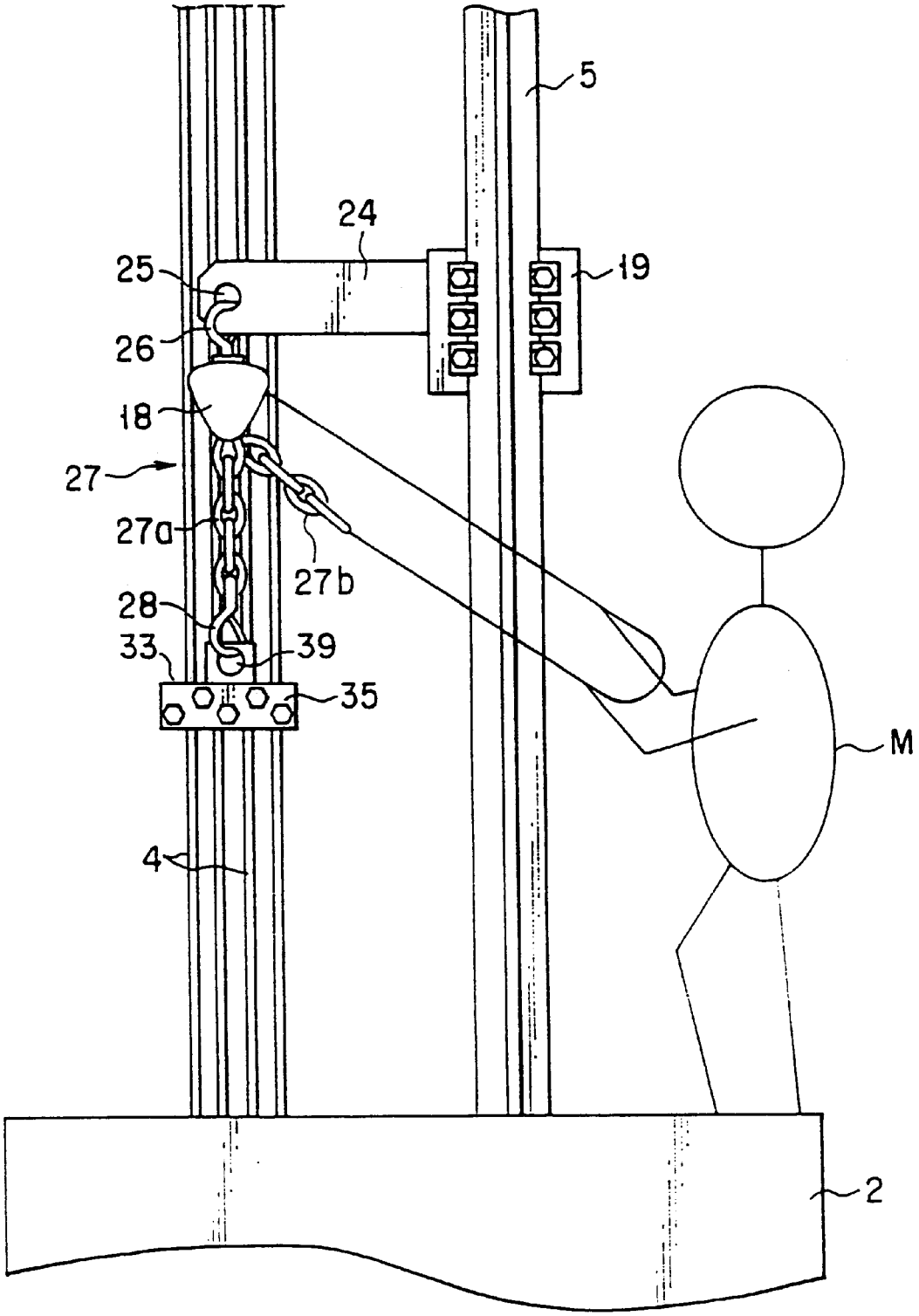
FIG. 4 is a front view showing a winding device according to a second embodiment of the invention.

FIGS. 1 to 3B show a first embodiment of the invention, in which FIG. 1 is a front view showing a winding device, FIGS. 2A to 2C are views showing a bracket mounting structure, and FIGS. 3A and 3B are schematic views showing an outline of a machine-room-less elevator.

Referring first to FIG. 3A, there will be described the general construction of the elevator. In an elevator shaft 1 provided in a building, a cage 2 and a counterweight 3 are suspended and balanced by means of a cable 4. Guide rails 5 and 6 for vertically guiding the cage 2 are arranged on the right- and left-hand sides, respectively, of the shaft 1, while counterweight guide rails 7 and 8 for guiding the counterweight 3 for up-and-down motion are arranged behind the left-hand guide rail 6.

On the left-hand side of the upper part of the interior of the elevator shaft 1, a drive unit 9 is set in a narrow space between an inner wall of the shaft 1 and a side wall of the cage 2. The drive unit 9, which is fixed to the guide rails 6 and 7, can wind up the cable 4, thereby relatively moving the cage 2 and the counterweight 3 up and down.

Thus, one end of the cable 4, which is wound up by the drive unit 9, is fixed to a cable hitch 10 that is attached to the upper end of the guide rail 5, while the other end is fixed to a cable hitch 11 that is attached to the upper end of the counterweight guide rail 8. A middle portion of the cable 4 is passed around two lower sheaves 12 that are attached to the lower part of the cage 2. The cable 2 then extends through the drive unit 9, and is then passed around a counterweight sheave 13 that is attached to the upper part of the counterweight 3. Note that, although, in the present embodiment, the two sheaves 12 are shown arranged along the direction parallel to a surface of a hall-door (not shown) of the elevator, the two sheaves 12 may be arranged along a direction inclined to the surface of the hall-door.

As shown in FIG. 3B, emergency stop mechanisms 14 are provided on the bottom portion of the cage 2. The mechanisms 14 serve to stop the cage 2 safely and securely in case the cage suddenly descends for any reason at a speed higher than its rated speed. The mechanisms 14 brake and compulsorily stop the cage 2 in a manner such that wedge members, for example, are caught between the cage 2 and the guide rail 6.

Figure 9A:
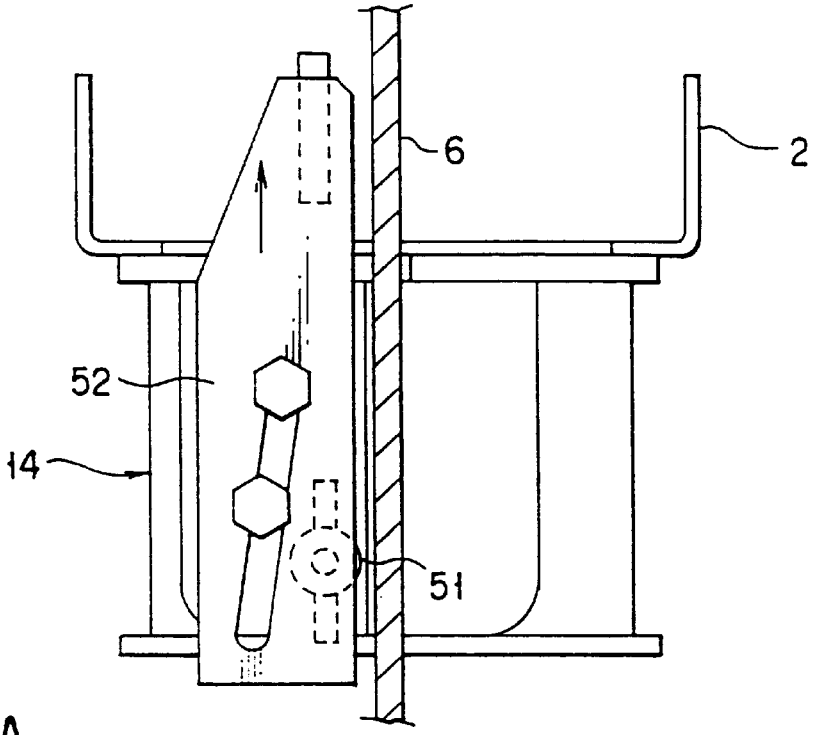
FIGS. 9A and 9B are schematic views showing an emergency stop mechanism.
Figure 9B:
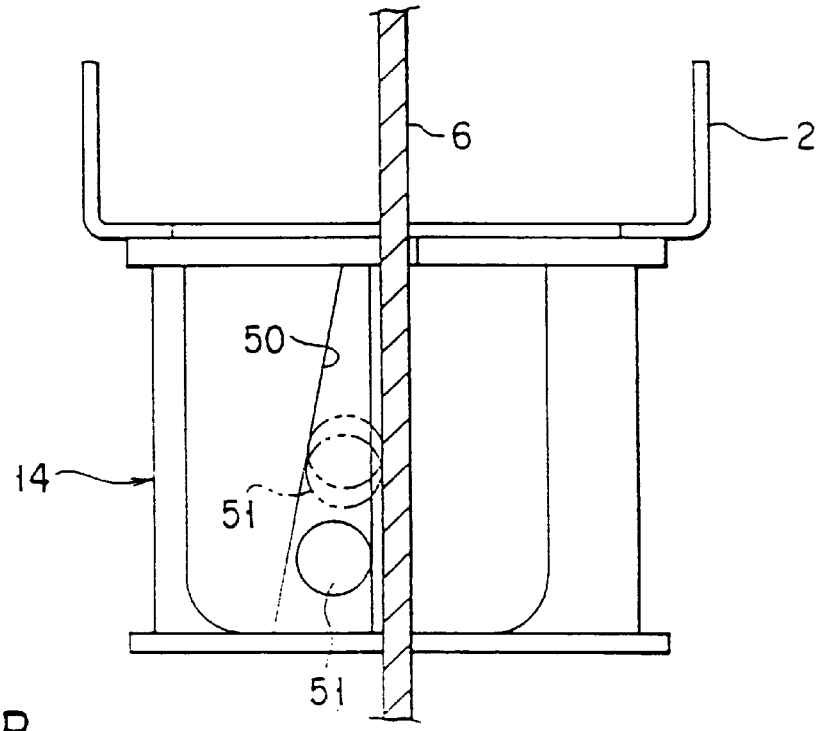

FIGS. 9A and 9B are enlarged schematic views showing one of the emergency stop mechanisms 14. The cage 2 is braked by driving a roller-shaped wedge member 51 between the guide rail 6 and a slope 50 on the cage side, as shown in FIG. 9B. The wedge member 51 is held by means of a holder 52 shown in FIG. 9A as it is moved to the position indicated by dashed line in FIG. 9B. The holder 52 is connected to a governor by means of a mechanism (not shown), as is known from Japanese Patent Publication (Kokai) No. 10-45347. If the cage 2 descends at a speed higher than a predetermined speed, the holder 52 is pulled up to actuate the emergency stop mechanism 14.

In order to cancel an emergency stop state established by the emergency stop mechanism 14, the cage 2 must be once lifted to disengage the wedge member 51.

FIG. 1 shows a chain block 18 for use as a winding device to lift the cage 2 and thereby release the emergency stop mechanism 14. The chain block 18 is suspended by a mounting member 17 that is attached to the guide rail 5 for positioning the cage 2.

As shown in FIGS. 2A to 2C, the mounting member 17 includes a bracket 19, which is wider than the basal part 5' of the guide rail 5 that has a substantially T-shaped cross section. The bracket 19 is bored with a plurality of bolt holes 20, which are arranged longitudinally at intervals a little longer than the width of the rail 5. Nuts 21 are provided on the back surface of the bracket 19, corresponding to respective of the bolt holes 20. Thus, the edge portions of the basal part 5' of the guide rail 5 can be held fixedly by tightening rail clips 22 from the front side of the bracket 19. As this is done, an arm 24 can be fastened together to the back side of the bracket 19.

As shown in FIG. 2B, a fitting hole 25 is formed in the distal end portion of the arm 24. As shown in FIG. 1, the chain block 18 is suspended from the hole 25 by means of an upper hook 26. A lower hook 28 is provided on one end portion 27*a* of a chain 27 that is wound around the block 18, and is hitched to an anchor 29 on the ceiling of the cage 2. An operator M can pull up the one end portion 27*a,* to which the lower hook 28 is attached, by holding the other end portion 27*b* of the chain 27 and endlessly running the chain.

Referring now to FIG. 1 and FIGS. 2A to 2*c,* there will be described a method for releasing the emergency stop mechanism 14, which is a feature of the present invention. When the mechanism 14 is activated so that the cage 2 is urgently stopped in the middle of the elevator shaft 1, the operator M gets on the ceiling of the cage 2 from a floor provided with an entrance, carrying the chain block 18 and the mounting member 17 with him. Then, the operator M presses the bracket 19 against the basal part of the guide rail 5 and inserts bolts 23, passed through the rail clips 22, into the bolt holes 20, individually, from the obverse side of the bracket 19.

As shown in FIGS. 2A and 2B, the guide rail 5 is an elongate structure formed by tying together a plurality of rails by means of joint plates 31 and bolts 32. Thus, the bracket 19 can be positioned by abutting the lower end face of the bracket 19 against an upper end face of one of the joint plates 31. After the bracket 19 is mounted in place, moreover, it can be prevented from shifting its position downward.

Then, the chain block 18 is suspended by anchoring its upper hook 26 to the fitting hole 25 in the distal end portion of the arm 24, and the lower hook 28 is hitched to the anchor 29 of the cage 2. If the operator M endlessly runs the other end portion 27*b* of the chain 27 of the chain block 18 in this state, the lower hook 28 is wound up gradually, so that the cage 2 ascends gradually. As the cage 2 ascends in this manner, the emergency stop mechanism 14 is released. Thus, any people confined to the cage 2 can be rescued speedily.

FIGS. 4, 5A, 5B and 5C show a second embodiment of the invention. An elevator according to this embodiment, unlike the one shown in FIG. 3A, is of a type such that, during lifting to disengage the wedge member 51, the cage 2 is suspended by means of the cable 4. In the first embodiment, the lower hook 28 of the chain block 18 is attached to the anchor 29 that is provided on the ceiling of the cage 2. In the present embodiment, however, a cable gripper 33 is mounted on the cable 4 for suspending the cage 2, and the lower hook 28 is attached to the gripper 33.

Figure 5A:
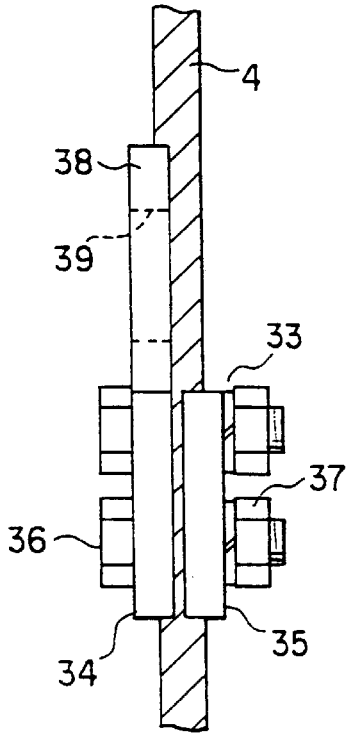
FIG. 5A is a side view of a cable gripper according to the second embodiment.
Figure 5B:
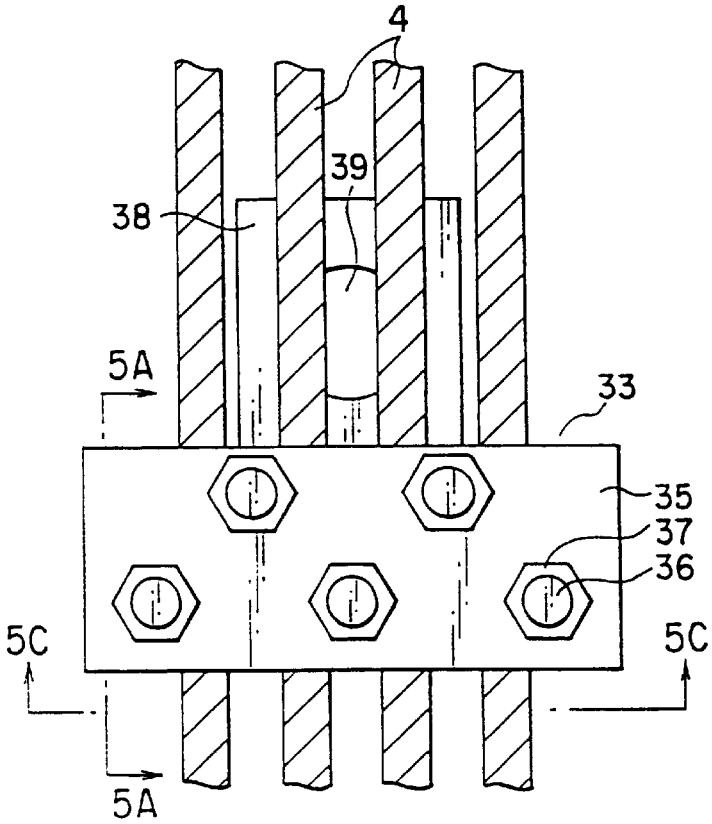
FIG. 5B is a front view of the cable gripper.
Figure 5C:
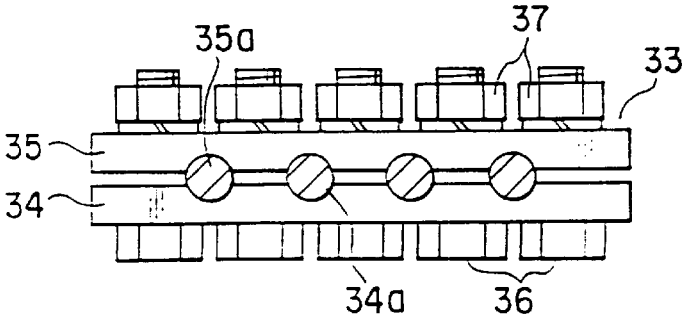
FIG. 5C is a sectional view of the cable gripper taken along the line 5C—5C of FIG. 5B.

As shown in FIGS. 5A to 5C, the cable gripper 33 is composed of two rectangular plate members 34 and 35 having a width greater than that of the rows of the cable 4. Four rows of the cable 4 are shown, it being understood that the number of rows of the cable 4 will vary in dependence on the rated load of the elevator. Thus, the gripper 33 can hold the four rows of the cable 4. The opposed surfaces of the plate members 34 and 35 are provided with fitting grooves 34*a* and 35*a,* respectively, in which the cable 4 is fitted. Further, a plurality of bolts 36 are arranged penetrating those regions of the members 34 and 35 which face the spaces between the cable rows, and nuts 37 are fitted on respective of the bolts 36. A lug 38 protrudes integrally upward from the one plate member 34. A fitting hole 39 is bored through the lug 38.

Thus, the cable gripper 33 can be attached to the cable 4 with the four rows of the cable 4 held between the two plate members 34 and 35 and clamped by means of the bolts 36 and the nuts 37. Further, the cage 2 can be raised by means of the cable 4 to release the emergency stop mechanism 14 in a manner such that the lower hook 28 of the chain block 18 is anchored to the fitting hole 39 of the gripper 33.

According to the second embodiment, the cage 2 can be lifted steadily without being tilted, and the cable gripper 33 can be mounted in any desired position on the cable 4.

Figure 6:
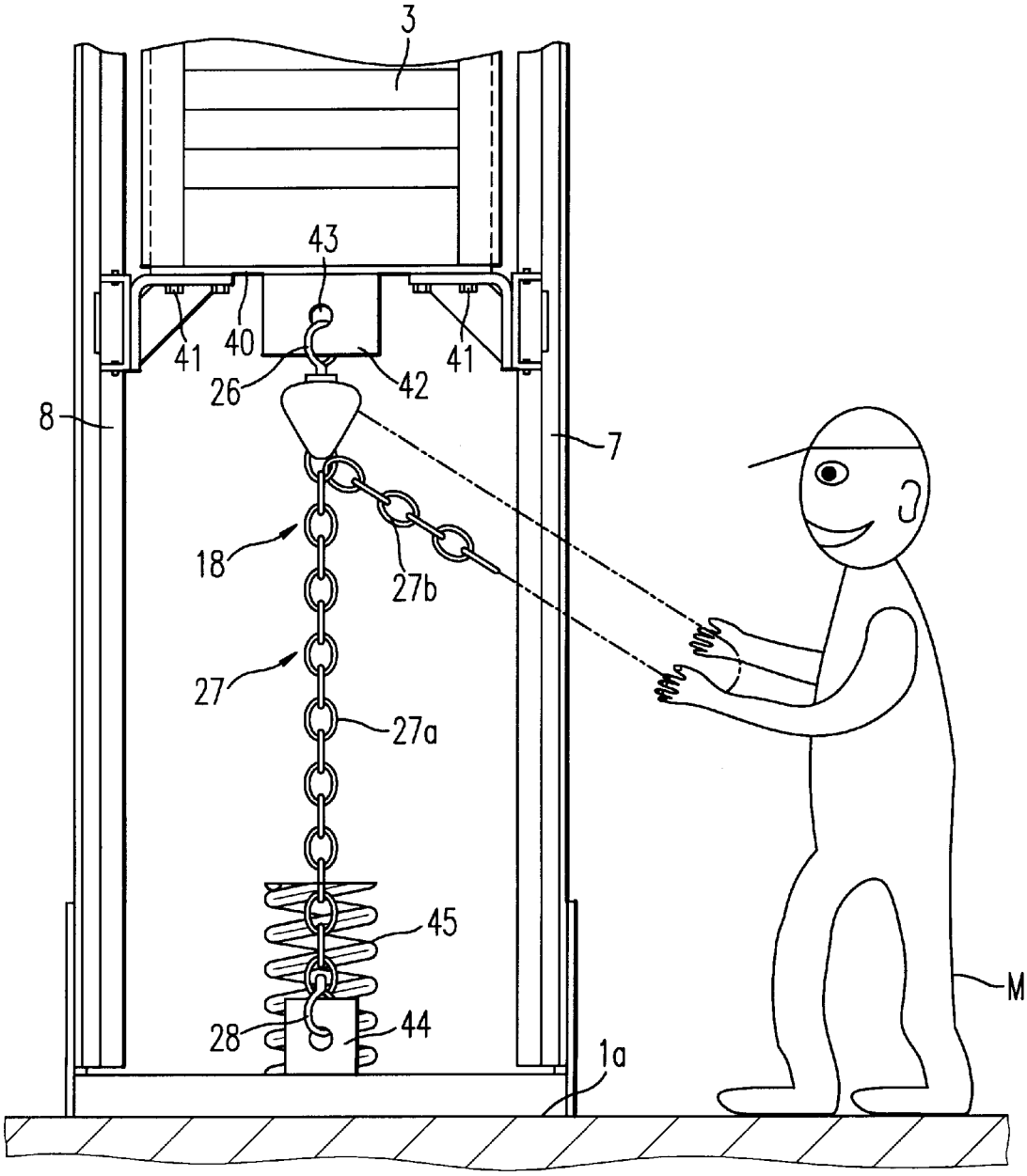
FIG. 6 is a front view showing a winding device according to a third embodiment of the invention.

FIG. 6 shows a third embodiment of the invention. In the first embodiment, the emergency stop state is canceled by directly hoisting the cage 2. In the third embodiment, however, the cage 2 is driven by driving the counterweight 3.

More specifically, according to this embodiment, a chain block 18 for use as a winding device is attached to a suspension base of a pit 1*a* of the elevator shaft 1 and a suspension base of the counterweight 3. The cage 2 is lifted to release the emergency stop mechanism 14 by lowering the counterweight 3 by means of the chain block 18.

A bracket 40 is attached by means of a plurality of bolts 41 to the lower part of the counterweight 3 that is supported by counterweight guide rails 7 and 8 for up-and-down motion.

Thus, the bracket 40 can ascend and descend integrally with the counterweight 3. A lug 42 protrudes downwardly from the crosswise middle portion of the bracket 40. A fitting hole 43 is bored through the lug 42.

An upper hook 26 of the chain block 18 is anchored to the fitting hole 43 so that the block 18 is suspended from the hole 43. A lower hook 28 on one end portion 27*a* of a chain 27 of the chain block 18 is hitched to an anchor 44 in the pit 1*a* of the elevator shaft 1. The shaft pit 1*a* is provided with a buffer 45 formed of a coil spring that can absorb the shock of dropping of the counterweight 3.

In the case where the cage 2 is located near the uppermost floor, it is hard for the operator M to get on its ceiling. With use of the arrangement described above, in this case, the operator M can get into the shaft pit 1*a,* anchor the upper hook 26 of the chain block 18 to the fitting hole 43 of the bracket 40 to suspend the block 18, and hitch the lower hook 28 to the anchor 44 of the shaft pit 1*a.* If the operator M endlessly runs the other end portion 27*b* of the chain 27 in this state, the one end portion 27*a* of the chain 27 is wound up gradually, so that the counterweight 3 descends, while the cage 2 ascends gradually. As the cage 2 ascends in this manner, the emergency stop mechanism 14 is released. Thus, any people confined to the cage 2 can be rescued speedily.

Figure 7:
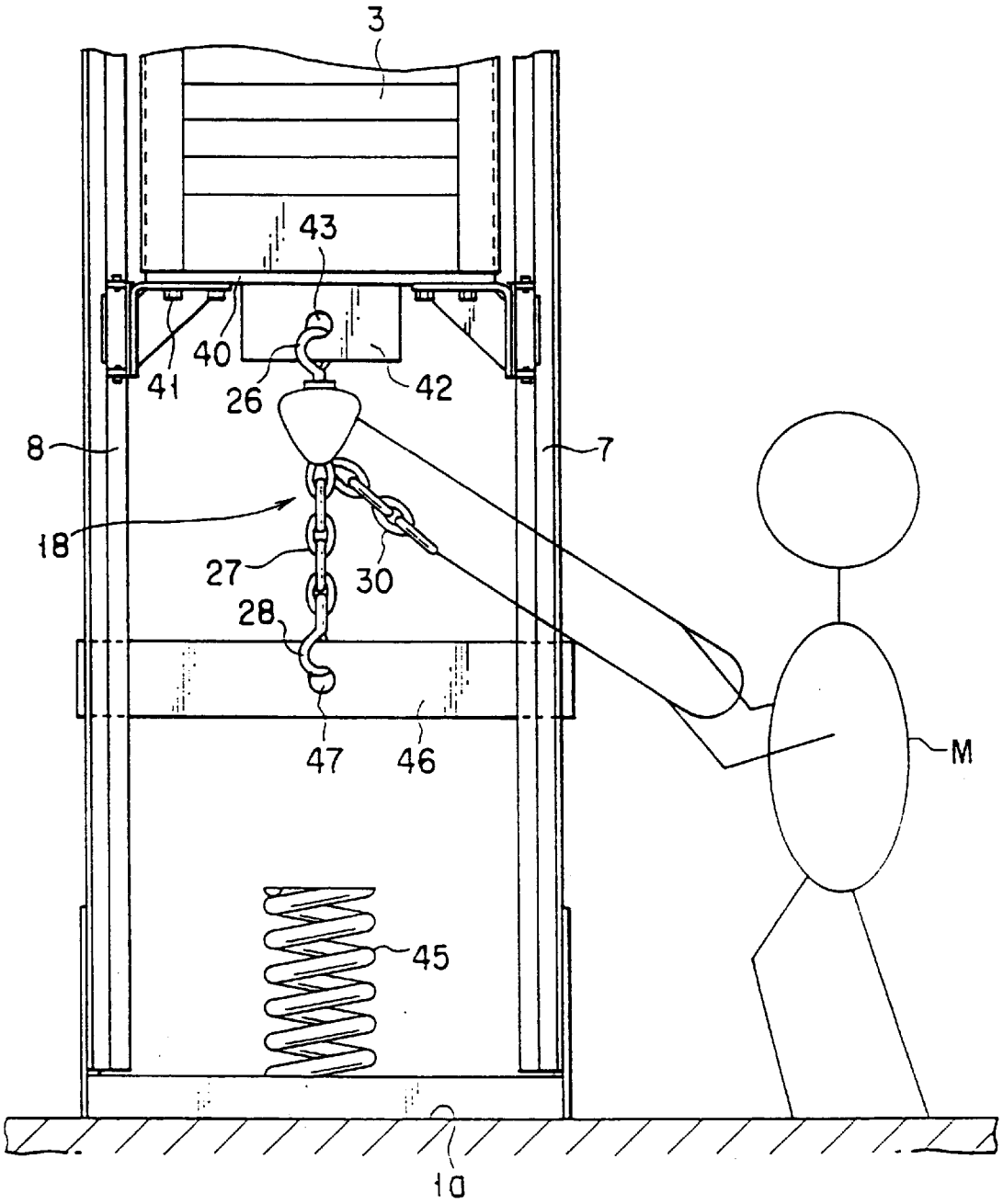
FIG. 7 is a front view showing a winding device according to a fourth embodiment of the invention.
Figure 8A:
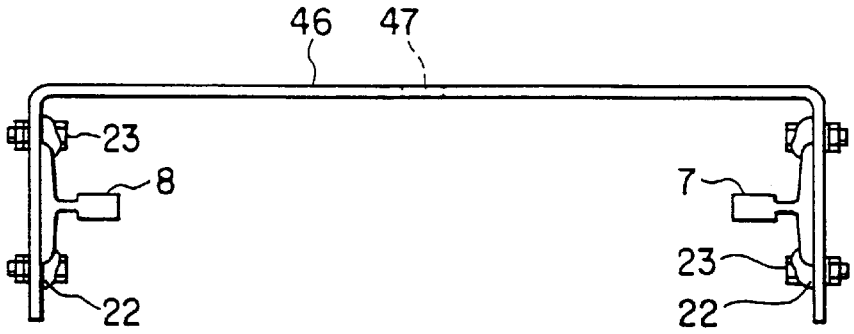
FIG. 8A is a plan view of a bracket mounting structure according to the fourth embodiment.
Figure 8B:
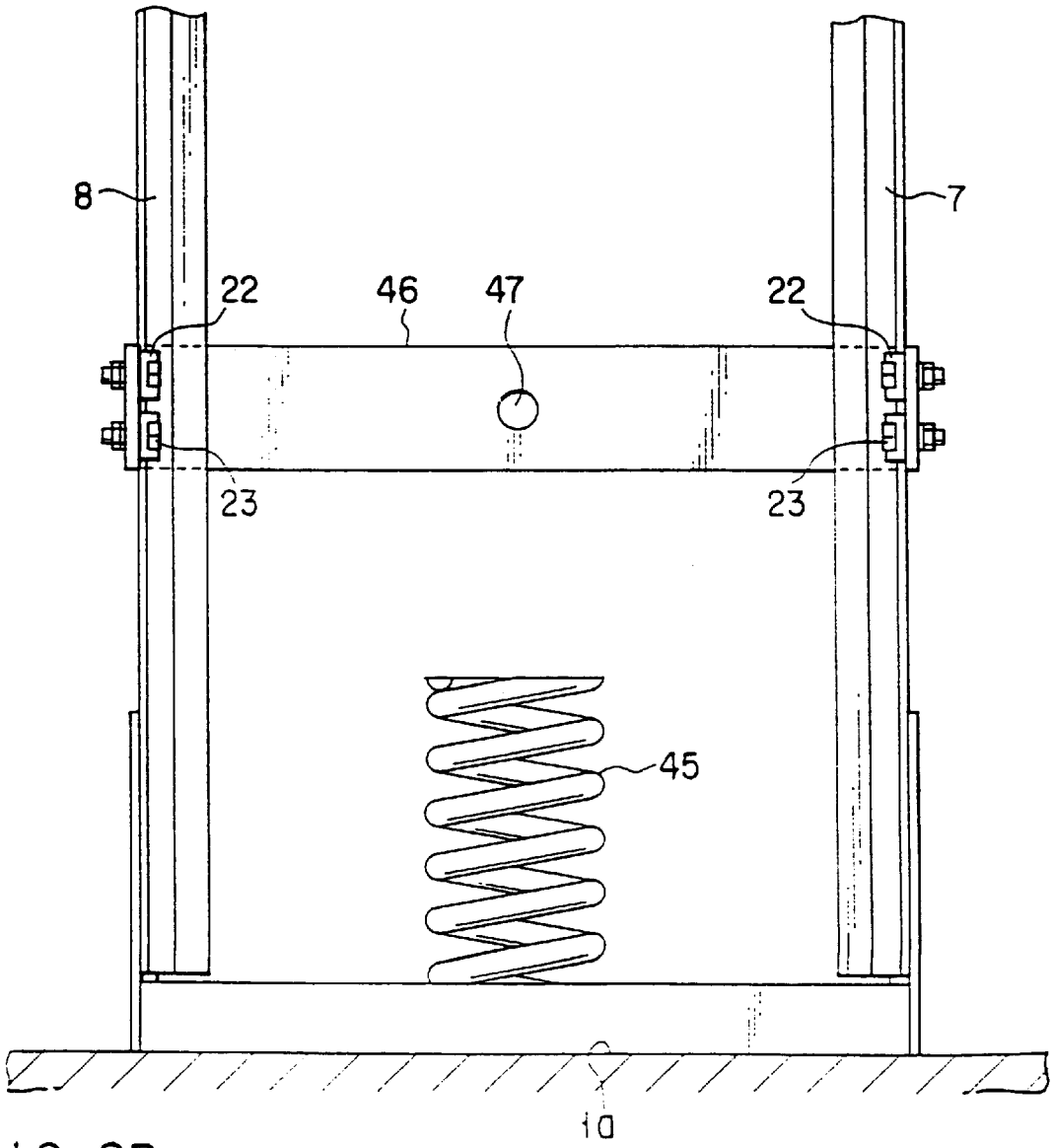
FIG. 8B is a front view of the bracket mounting structure.

FIGS. 7, 8A and 8B show a fourth embodiment of the invention, in which a chain block 18 for use as a winding device is attached to a suspension base at the respective lower parts of counterweight guide rails 7 and 8 and a suspension base of a counterweight 3. A cage 2 is lifted to release the emergency stop mechanism 14 by lowering the counterweight 3 by means of the chain block 18.

A bracket 46 is located corresponding to those portions of the counterweight guide rails 7 and 8 which are located below the counterweight 3. The bracket 46 is attached to the rails 7 and 8 by means of rail clips 22 similar to the ones according to the first embodiment. A fitting hole 47 is bored through the longitudinal middle portion of the bracket 46.

An upper hook 26 of the chain block 18 is anchored to a fitting hole 43 of a lug 42 so that the block 18 is suspended from the hole 43. A lower hook 28 on one end portion 27*a* of a chain 27 of the chain block 18 is hitched to the fitting hole 47 of the bracket 46 that is attached to the counterweight guide rails 7 and 8.

In the case where the cage 2 is located near the uppermost floor, it is hard for the operator M to get on the ceiling of the cage 2. With use of the fourth embodiment of the present invention, in this case, the operator M can get into a shaft pit 1*a,* anchor the upper hook 26 of the chain block 18 to the fitting hole 43 of the lug 42 to suspend the block 18, and hitch the lower hook 28 to the fitting hole 47 of the bracket 46. If the operator M endlessly runs the other end portion 27*b* of the chain 27 in this state, the one end portion 27*a* of the chain 27 is wound up gradually, so that the counterweight 3 descends, while the cage 2 ascends gradually. As the cage 2 ascends in this manner, the emergency stop mechanism 14 is released. Thus, any people confined to the cage 2 can be rescued speedily.

The construction of the chain block 18 in each of the embodiments described herein is given only as an example, and winding devices of various other types may be used in place of the chain block 18.

Various additional modifications and variations of the present invention are possible in light of the above teachings. It is therefore to be understood that within the scope of the appended claims, the present invention may be practiced differently than as specifically described herein.

What is claimed as new and desired to be secured by Letters Patent of the United States is:

1. An emergency stop state releasing method for an elevator, which includes a cage configured to ascend and descend along a first guide rail in an elevator shaft, a counterweight configured to ascend and descend along a second guide rail in said elevator shaft, a cable for suspending said cage and said counterweight, a drive unit in said elevator shaft for driving said cable to move said cage up and down in said elevator shaft, and an emergency stop mechanism attached to said cage and configured to engage said guide rail, thereby urgently stopping said cage, and to lift said cage, thereby canceling an emergency stop state, comprising steps of:

setting a removable winding device in said elevator shaft; and driving one of said cage and said counterweight by means of said winding device to lift said cage and cancel said emergency stop state.

2. The method as recited in claim 1, wherein said setting step comprises:

removably mounting said winding device on a portion of said guide rail located above said cage and lifting said cage by means of said winding device.

3. The method as recited in claim 2, wherein said setting step comprises:

fixing a bracket in a position on said guide rail by means of rail clips and mounting said winding device on said bracket.

4. The method as recited in claim 1, wherein:

said setting step comprises removably mounting said winding device on said counterweight; and said driving step comprises driving said counterweight downward by means of said winding device.

5. The method as recited in claim 4, wherein:

said setting step comprises removably attaching a bracket to a portion of said guide rail located below said counterweight, and setting said winding device between said counterweight and said bracket; and said driving step comprises driving said counterweight downward with respect to said bracket by means of said winding device.

6. The method as recited in claim 1, comprising:

using a chain block as said winding device.

* * * * *